US012680426B2

(12) United States Patent
Otaif et al.

(10) Patent No.: US 12,680,426 B2
(45) Date of Patent: Jul. 14, 2026

(54) INTEGRATED MILL AND PERFORATING DOWNHOLE TOOL

(71) Applicant: SAUDI ARABIAN OIL COMPANY, Dhahran (SA)

(72) Inventors: Hassan Wafi Otaif, Dhahran (SA); Abdulaziz Khalaf S. Alanazi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/674,185

(22) Filed: May 24, 2024

(65) Prior Publication Data

US 2025/0361799 A1 Nov. 27, 2025

(51) Int. Cl.
*E21B 43/119* (2006.01)
*E21B 34/06* (2006.01)

(52) U.S. Cl.
CPC ..... *E21B 43/119* (2013.01); *E21B 34/063* (2013.01)

(58) Field of Classification Search
None
See application file for complete search history.

(56) References Cited

U.S. PATENT DOCUMENTS 2,174,077 A 9/1939 Bowen
5,044,388 A * 9/1991 Barton ..... E21B 43/116 137/15.08
5,890,539 A * 4/1999 Huber ..... E21B 43/11852 166/297
6,053,248 A * 4/2000 Ross ..... E21B 43/116 166/387
6,155,350 A * 12/2000 Melenyzer ..... E21B 34/14 166/317
6,648,075 B2 * 11/2003 Badrak ..... E21B 23/0411 166/207
6,920,930 B2 * 7/2005 Allamon ..... E21B 23/0413 166/332.8
7,083,209 B2 8/2006 Leman et al.
8,789,602 B2 * 7/2014 Gill ..... E21B 23/04 166/332.8
8,967,300 B2 * 3/2015 Dewey ..... E21B 10/322 166/383
9,284,823 B2 * 3/2016 Kratochvil ..... E21B 43/112
10,208,572 B2 * 2/2019 Cook ..... E21B 43/112
(Continued)

*Primary Examiner* — Tara Schimpf
*Assistant Examiner* — Ursula Lee Norris
(74) *Attorney, Agent, or Firm* — Vorys, Sater, Seymour and Pease LLP

(57) ABSTRACT

An integrated mill and perforating downhole tool includes an elongate body having opposing first and second ends and defining a fluid passage extending therebetween to receive a fluid, a mill operatively coupled to the body at the second end, and a perforating tool operatively coupled to the body at a location between the first and second ends. A ball seat is arranged within the fluid passage and movable between a first position, where one or more bypass ports defined in the body are blocked, and a second position, where the bypass ports are exposed and facilitate fluid communication to the perforating tool. The mill is operable when the ball seat is in the first position, and, when the ball seat is in the second position, fluid pressure within the fluid passage communicates with the perforating tool via the one or more bypass ports to actuate the perforating tool.

20 Claims, 9 Drawing Sheets

(56) References Cited

U.S. PATENT DOCUMENTS

| | | | | |
|---|---|---|---|---|
| 10,900,332 | B2 * | 1/2021 | Al-Anazi | E21B 43/112 |
| 11,162,325 | B2 * | 11/2021 | Tunes | E21B 29/08 |
| 2003/0070811 | A1 * | 4/2003 | Robison | E21B 43/116 166/298 |
| 2011/0240294 | A1 * | 10/2011 | Johnston | E21B 43/112 166/55.7 |
| 2014/0069649 | A1 | 3/2014 | Streater et al. | |
| 2016/0237793 | A1 * | 8/2016 | Albers | E21B 43/112 |
| 2017/0175498 | A1 * | 6/2017 | Segura | E21B 37/00 |
| 2018/0128082 | A1 * | 5/2018 | Hollan | E21B 34/10 |
| 2018/0347330 | A1 * | 12/2018 | Facca | E21B 34/14 |
| 2019/0010803 | A1 * | 1/2019 | Purkis | E21B 17/20 |
| 2020/0386069 | A1 * | 12/2020 | Stone | E21B 34/142 |
| 2025/0320794 | A1 * | 10/2025 | De Florio | E21B 43/112 |

* cited by examiner

INTEGRATED MILL AND PERFORATING DOWNHOLE TOOL

FIELD OF THE DISCLOSURE

The present disclosure relates generally to downhole tools used in the oil and gas industry and, more particularly, to a downhole tool for performing milling and perforating operations within a wellbore.

BACKGROUND OF THE DISCLOSURE

Obtaining hydrocarbons from subterranean reservoirs typically involves several stages including drilling, completion, production, workover, and abandonment. During these stages, it may be necessary to carry out milling operations to clean out the well or to perform drift runs to ensure that the well is clear of obstructions and that the diameter of the wellbore, the casing the lines the wellbore, or other tubing allows free passage of downhole equipment and tools. In addition, it may be necessary to carry out perforating or punching operations to create perforations in reservoir formations or in wellbore components such as the casing, cement sheaths, tubing, and the like. Perforations in wellbore components may permit fluid communication between certain zones within the well to aid in circulation of various fluids such as drilling mud, completion fluids, fracturing fluids, acidizing fluids and kill fluids through the well or to allow fluids to be introduced into a particular zone with greater precision. Further, perforations may be necessary for remedial and/or sidetrack operations, or for enabling installation of various downhole equipment such as valves, sensors, sleeves, and pumps.

Milling tools are conventionally deployed downhole as part of a drill string and, more specifically, as part of a bottom hole assembly (BHA) arranged at the end of the drill string. In contrast, punching tools or perforators are often deployed downhole using slickline, wireline, or coiled tubing. Consequently, in cases where both milling and punching (perforating) are required, separate runs are required to complete both operations. Due to the significant depth of oil wells, performing separate runs to lower different tools for milling and punching operations is time consuming and costly.

What is needed, therefore, is a downhole tool capable of carrying out both milling and perforating operations within a wellbore in a single run to reduce the time taken to complete both operations.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, an integrated mill and perforating downhole tool is disclosed and includes an elongate body having opposing first and second ends and defining a fluid passage extending therebetween to receive a fluid, a mill operatively coupled to the body at the second end, a perforating tool operatively coupled to the body at a location between the first and second ends, and a ball seat arranged within the fluid passage and movable between a first position, where one or more bypass ports defined in the body are blocked, and a second position, where the one or more bypass ports are exposed and facilitate fluid communication between the fluid passage and the perforating tool, wherein the mill is operable when the ball seat is in the first position, and wherein, when the ball seat is in the second position, fluid pressure within the fluid passage communicates with the perforating tool via the one or more bypass ports to actuate the perforating tool.

According to another embodiment consistent with the present disclosure, a method of milling and punching within a wellbore is disclosed and includes conveying an integrated mill and perforating downhole tool into the wellbore on a drill string, the integrated mill and perforating downhole tool including an elongate body having opposing first and second ends and defining a fluid passage extending therebetween, a mill operatively coupled to the body at the second end, a perforating tool operatively coupled to the body at a location between the first and second ends, and a ball seat arranged within the fluid passage and defining a central aperture. The method may further include circulating a fluid into the fluid passage, through the central aperture, and to the mill when the ball seat is in a first position, where one or more bypass ports defined in the body are blocked, moving the ball seat to a second position, where the one or more bypass ports are exposed, and circulating the fluid to the perforating tool via the one or more bypass ports and thereby actuating the perforating tool.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
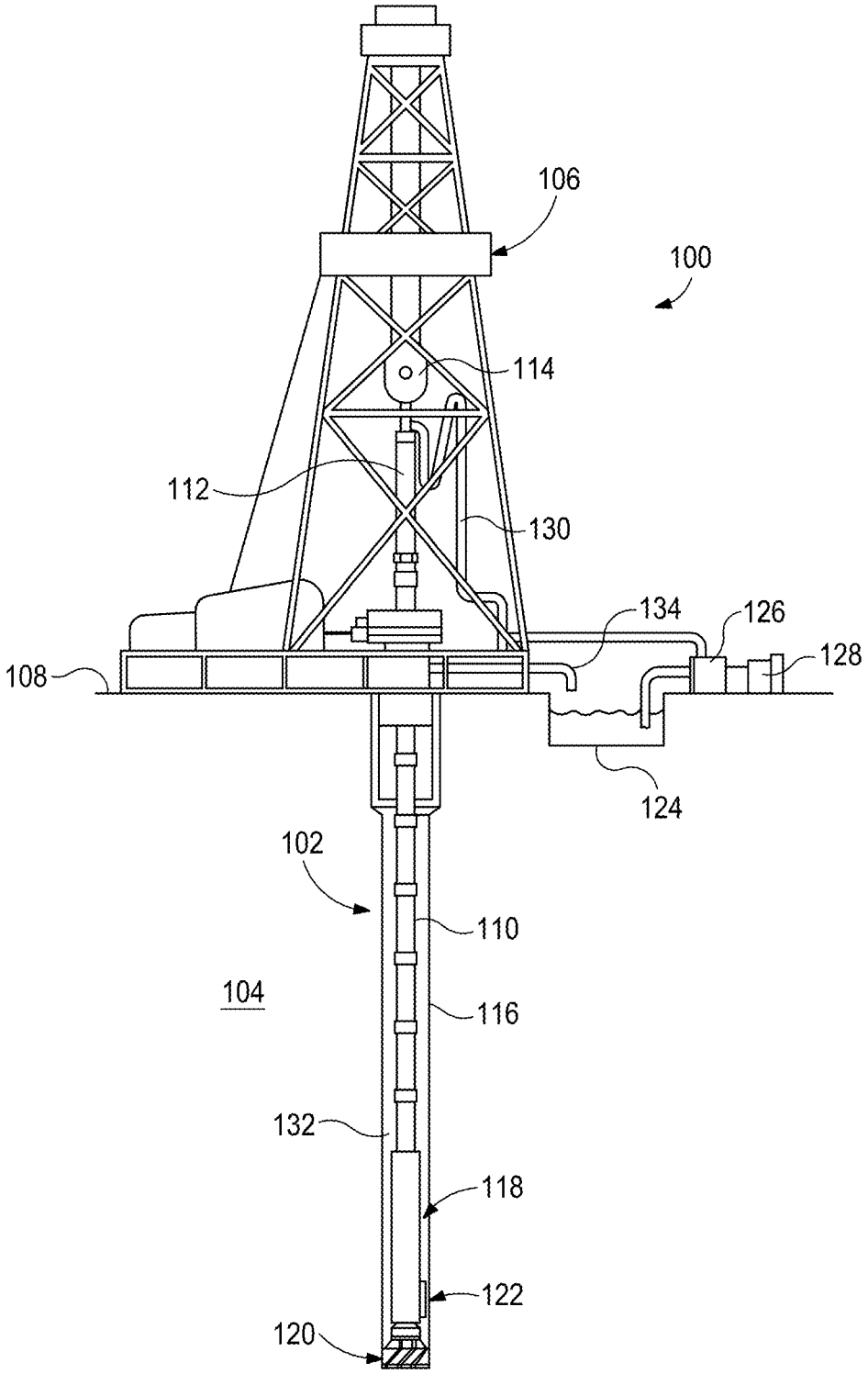
FIG. 1 is a schematic diagram of an example well system that may employ the principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to downhole tools used in the oil and gas industry and, more particularly, to an integrated mill and perforating downhole tool designed to perform both milling and perforating operations within a wellbore in a single run, which reduces the time taken to complete both operations. In comparison with current multi-run methods, the integrated mill and perforating downhole tool of the present disclosure combines a milling tool and a punching tool so that milling and perforating operations within the well can be performed in a single run, significantly reducing the time and cost to complete both operations.

FIG. 1 illustrates an example well system 100 that may employ one or more principles of the present disclosure. As illustrated, the well system 100 (hereafter "the system 100") includes a wellbore 102 extending into the earth 104 from a surface installation 106 arranged at the well surface 108. In the illustrated embodiment, the surface installation 106 comprises a drilling rig that includes a derrick, and a drill string 110 extends into the wellbore 102 from the surface installation 106. The drill string 110 is lowered and raised within the wellbore 102 using a kelly 112 and a traveling block 114 mounted to the derrick.

A string of tubing 116 may be arranged within the wellbore 102 and the drill string 110 may be extended into the interior of the tubing 116. The tubing 116 may comprise, for example, a string of casing or wellbore liner that lines the inner wall of the wellbore 102, and may be secured in place with cement. In such applications, the casing or liner may line all or only a select portion of the wellbore 102. In other embodiments, however, the tubing 116 may comprise a string of production tubing extended into the wellbore 102 from the surface installation 106.

According to embodiments of the present disclosure, an integrated mill and perforating downhole tool 118 may be arranged at the downhole end of the drill string 110 and conveyed into the wellbore 102. As described herein, the integrated mill and perforating downhole tool 118 (hereafter "the downhole tool 118") may be used to help mill or clean out portions of the wellbore 102 (e.g., within the tubing 116) as needed, and selectively perforate portions of the tubing 116. To accomplish these operations, the downhole tool 118 may include a mill 120 and a perforating tool 122.

As illustrated, the mill 120 may be arranged downhole from the perforating tool 122 and otherwise positioned at the downhole end of the downhole tool 118. The mill 120 may be operable to mill or clean out portions of the wellbore 102 and, more particularly, the tubing 116. To help accomplish this, a fluid from a surface tank 124 may be pumped downhole using a pump 126 powered by an adjacent power source, such as a prime mover or motor 128. In at least one embodiment, the fluid may comprise drilling fluid or "mud". The fluid is pumped from the surface tank 124, through a stand pipe 130, which feeds the fluid into the drill string 110 and conveys the same to the downhole tool 118. The fluid circulates to and exits the mill 120 where it is discharged into the surrounding annulus 132 defined between the drill string 110 and the inner wall of the tubing 116. During milling operations, the mill 120 may be rotated by rotating the entire drill string 110 from the surface installation 106. Cuttings and debris generated by operating the mill 120 are circulated back to the surface 108 within the annulus 132. The cuttings and fluid mixture are passed through a flow line 134 and are processed such that a cleaned fluid is returned downhole through the stand pipe 130 once again.

Once the downhole tool 118 is arranged at a desired location within the wellbore 102, the perforating tool 122 may be actuated to selectively perforate a portion of the tubing 116. In some embodiments, the perforating tool 122 may be hydraulically operable. In such embodiments, as described in greater detail below, increasing the fluid pressure within the drill string 110 can cause the perforating tool 122 to actuate and thereby generate a perforation in the wall of the tubing 116 one or more select locations.

Figure 2:
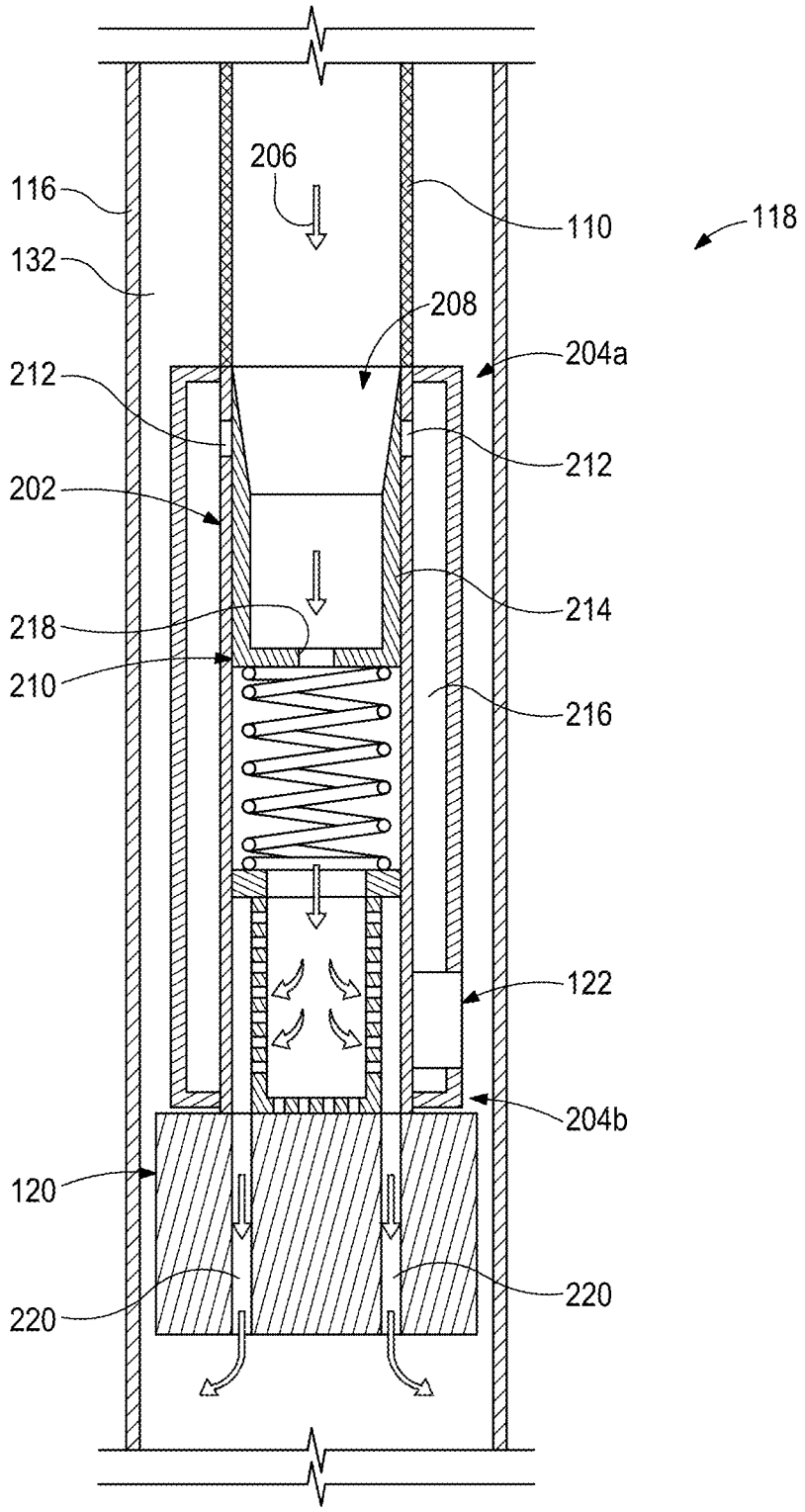
FIG. 2 is an enlarged, partial cross-sectional side view of the downhole tool of FIG. 1, according to one or more embodiments.

FIG. 2 is an enlarged, partial cross-sectional side view of the downhole tool 118, according to one or more embodiments. As illustrated, the downhole tool 118 is arranged within the tubing 116, and the annulus 132 is defined between the inner wall of the tubing 116 and a combination of the drill string 110 and the downhole tool 118. The downhole tool 118 may provide a generally elongate and tubular body 202 having a first or "uphole" end 204*a* and a second or "downhole" end 204*b* opposite the uphole end 204*a*. The uphole end 204*a* may be operatively coupled to a downhole end of the drill string 110, which may comprise a plurality of tubes or pipe connected end-to-end. The mill 120 is operatively coupled to the downhole end 204*b*, and the perforating tool 122 is operatively coupled to the body 202 and otherwise arranged at a location between the uphole and downhole ends 204*a,b*.

The body 202 may be manufactured from a material with high strength, durability and corrosion resistance. Example materials include, but are not limited to, a steel alloy, stainless steel, a nickel-based alloy, a chromium-based alloy, a titanium alloy, a composite material, and any combination thereof. The body 202 defines a fluid passage 208 capable of receiving a fluid 206 conveyed to the downhole tool 118 via the drill string 110. In some applications, the fluid 206 may comprise drilling fluid or mud, as mentioned above, but could alternatively comprise other types of muds used as a primary well control barrier.

Figure 3:
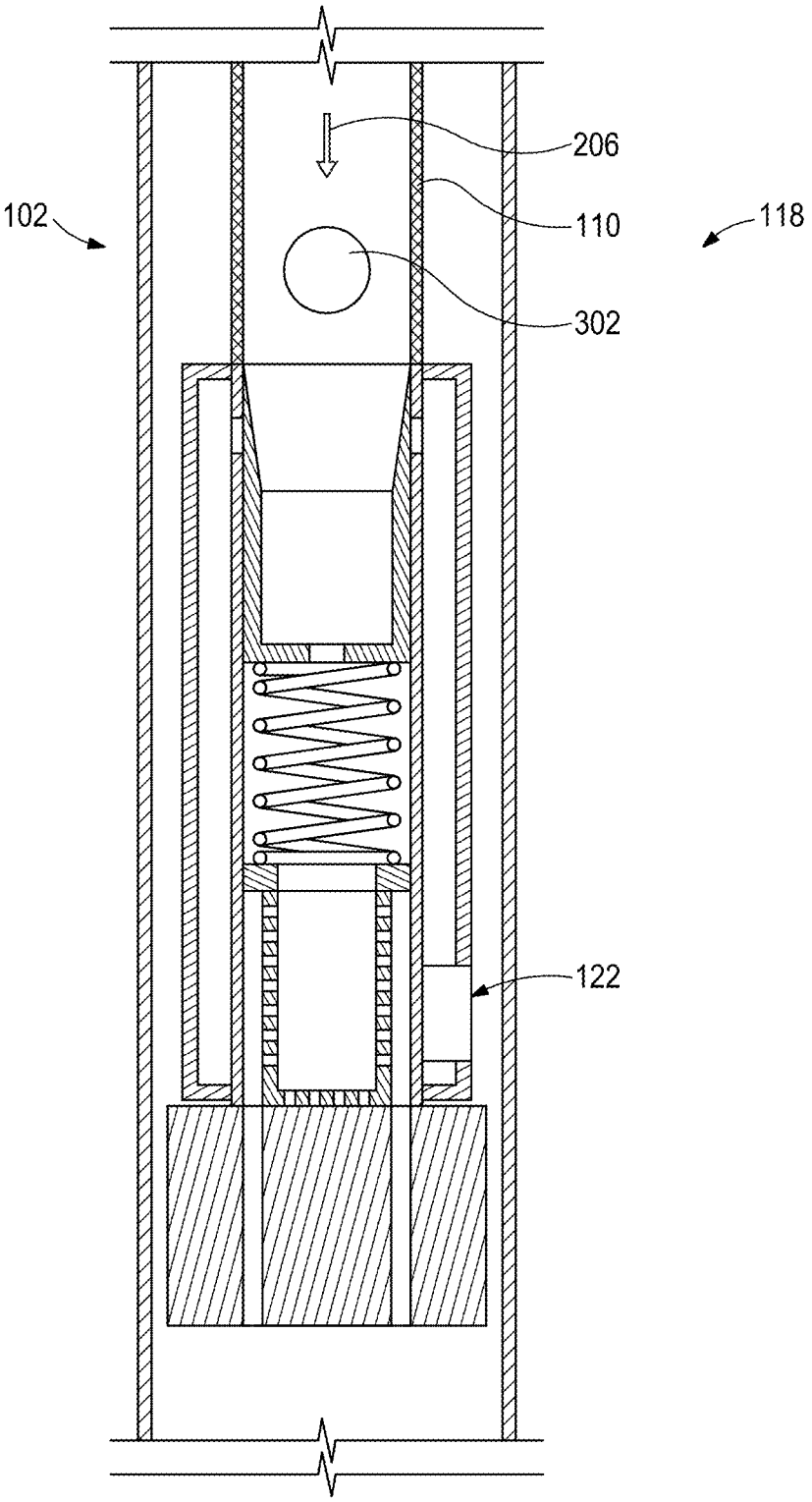
FIGS. 3-8 are enlarged, partial cross-sectional side views of the downhole tool of FIG. 2 depicting progressive steps of example operation, according to one or more embodiments.
Figure 4:
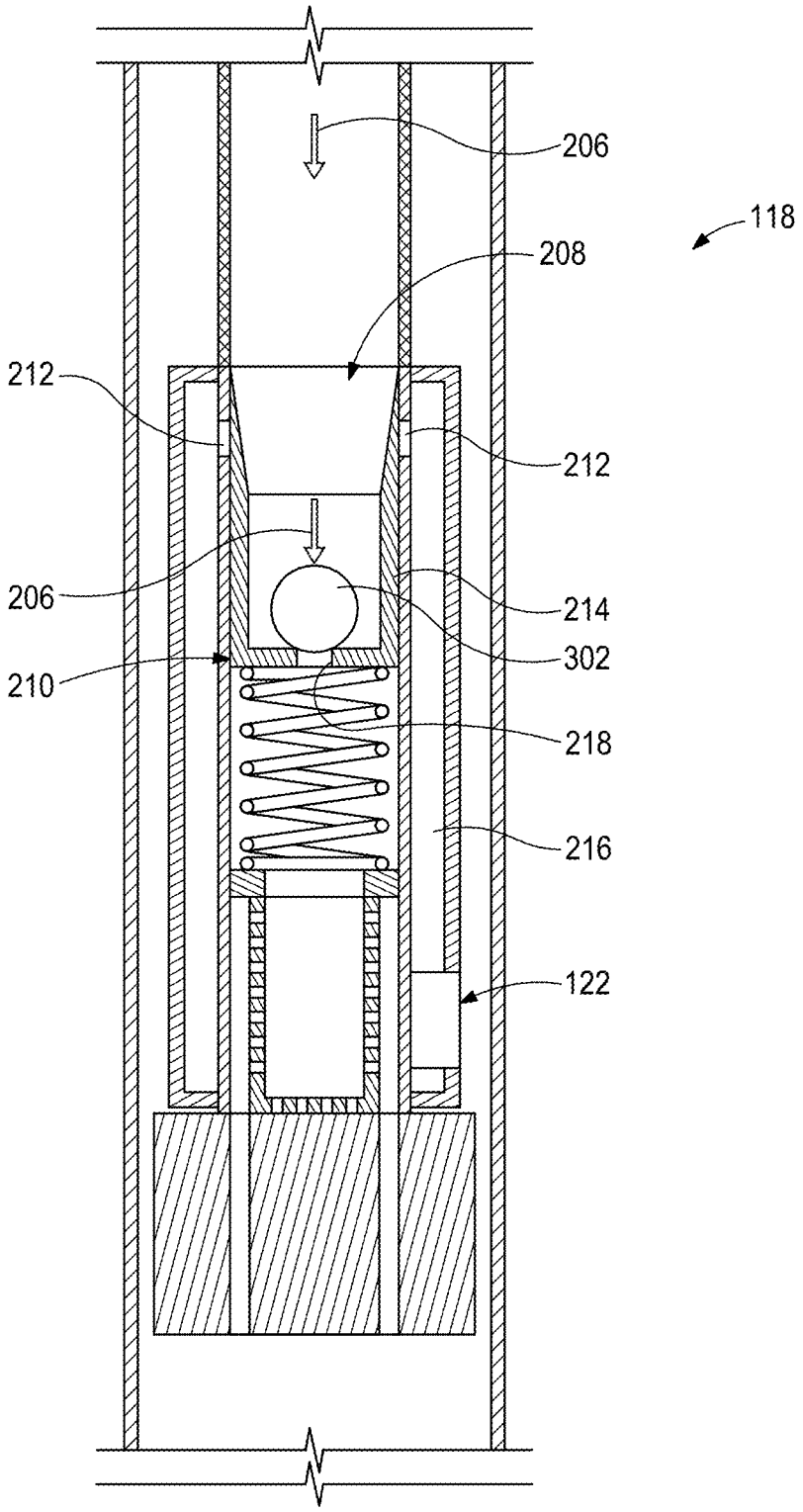
Figure 5:
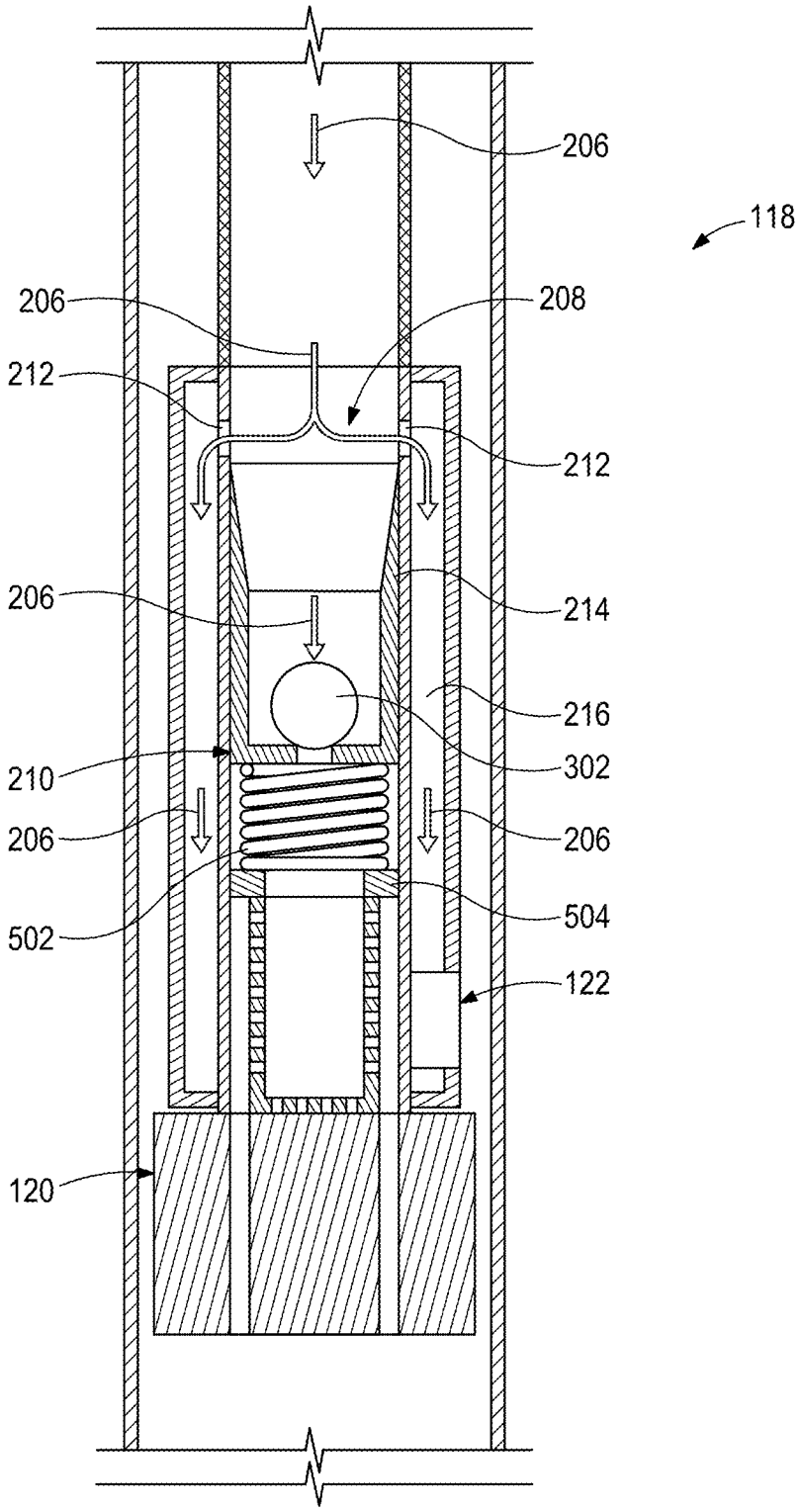
Figure 6:
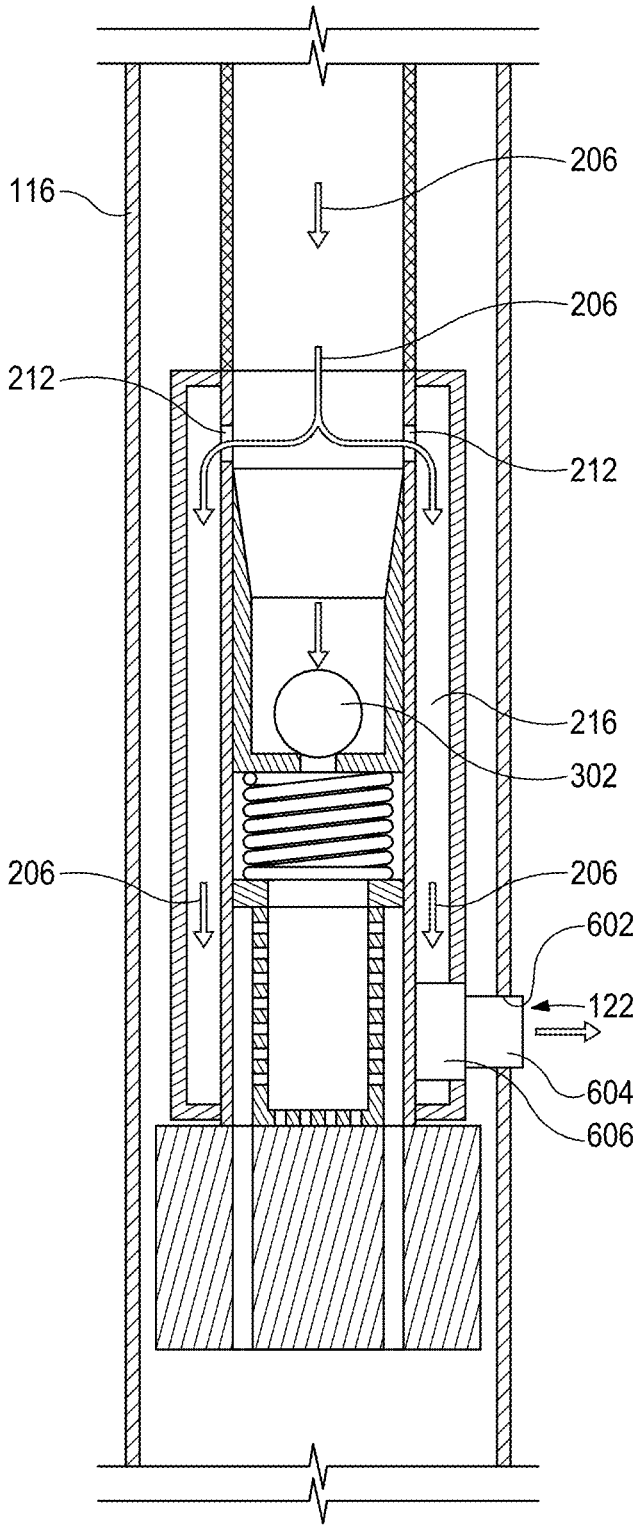

As illustrated, the downhole tool 118 may further include a ball seat 210 arranged within the fluid passage 208 and movable between a first position, as shown in FIGS. 2-4, and a second position, as shown in FIGS. 5 and 6. When the ball seat 210 is in the first position, one or more bypass ports 212 (two shown) defined in a sidewall of the body 202 may be blocked (occluded). In some embodiments, for example, the ball seat 210 may include a sliding sleeve 214, or the sliding sleeve 214 may be operatively coupled thereto such that moving the ball seat 210 between the first and second positions correspondingly moves the sliding sleeve 214. When the ball seat 210 is in the first position, the sliding sleeve 214 occludes the bypass ports 212, and when the ball seat 210 moves to the second position, the sliding sleeve 214 correspondingly moves to expose the bypass ports 212.

In some embodiments, the bypass ports 212 may be in fluid communication with the perforating tool 122 via a hydraulic actuation chamber 216. In such embodiments, the hydraulic actuation chamber 216 may comprise a chamber or compartment at least partially surrounding a portion of the body 202. The hydraulic actuation chamber 216 may alternatively comprise a conduit or channel defined in the sidewall of the body 202. In such embodiments, the hydraulic actuation chamber 216 may be rifle drilled into the body 202 to communicate with the perforating tool 122. When the ball seat 210 moves to the second position and the bypass ports 212 become exposed, the fluid 206 within the fluid passage 208 may be able to communicate with the perforating tool 122 via the hydraulic actuation chamber 216 to thereby actuate the perforating tool 122.

When the ball seat 210 is in the first position, the downhole tool 118 may be configured for operation of the mill 120. In particular, the ball seat 210 may provide or otherwise define a central aperture 218 through which the fluid 206 can circulate to bypass the ball seat 210 and be received at the mill 120 downstream from the ball seat 210. At the mill 120, the fluid 206 may be conveyed through one or more nozzles 220 defined in the mill 120 and subsequently discharged into the surrounding annulus 132, as generally described above. Example milling operations include, but are not limited to, cleaning out obstructions and debris within the tubing 116, conducting drift runs, removing tools (e.g., port collars, packers, bridge plugs, etc.) from the wellbore 102, removing a part of the tubing 116, or any combination thereof. Conventionally, drift runs are undertaken to determine if any obstructions are found within the wellbore 102 (first run), following which a mill is conveyed downhole to clean (mill out) the obstructions (second run), following which a perforating tool is conveyed downhole to perforate tubing (third run). The downhole tool 118 described herein accomplishes these tasks in a single run into the wellbore 102.

FIGS. 3-8 are enlarged, partial cross-sectional side views depicting progressive steps of example operation of the downhole tool 118, according to one or more embodiments. More specifically, FIGS. 3-8 depict example operation of the perforating tool 122 and subsequent re-activation of the mill 120, according to the principles of the present disclosure.

In FIG. 3, when it is desired to actuate (operate) the perforating tool 122 and thereby perforate the tubing 116 at a desired location within the wellbore 102, a wellbore projectile 302 may be conveyed to the downhole tool 118 via the drill string 110. The wellbore projectile 302 may comprise, for example, a ball or a dart. In some embodiments, the wellbore projectile 302 may be conveyed to the downhole tool 118 under gravitational forces (e.g., physically dropped into the wellbore 102). In other embodiments, however, the wellbore projectile 302 may be pumped to the downhole tool 118 using the fluid 206.

In FIG. 4, upon reaching the downhole tool 118, the wellbore projectile 302 may enter the fluid passage 208 and locate the ball seat 210. Upon locating the ball seat 210, the wellbore projectile 302 may also occlude or otherwise be received at the central aperture 218 defined in the ball seat 210. Once the wellbore projectile 302 is received at the central aperture 218, the fluid 206 is prevented from bypassing (flowing past) the ball seat 210 in the downhole direction. The fluid pressure within the fluid passage 208 may then be increased to cause the ball seat 210 to transition from the first position, as shown in FIGS. 2-4, to the second position, as shown in FIGS. 5 and 6. As mentioned above, with the ball seat 210 in the first position, the bypass ports 212 are blocked (occluded) by the sliding sleeve 214, thereby preventing fluid communication with the perforating tool 122 (e.g., via the hydraulic actuation chamber 216) and simultaneously preventing the perforating tool 122 from being actuated.

In FIG. 5, the fluid pressure within the fluid passage 208 has been increased and the fluid 206 has acted on the ball seat 210 to move the ball seat 210 downhole from the first position to the second position. As the ball seat 210 moves to the second position, the sliding sleeve 214 correspondingly moves to expose the bypass ports 212, thus placing the fluid passage 208 in fluid communication with perforating tool 122. As mentioned above, in some embodiments, the bypass ports 212 may fluidly communicate with the perforating tool 122 via the annulus 132, but could alternatively communicate the fluid 206 to the perforating tool 122 via the hydraulic actuation chamber 216.

In some embodiments, as illustrated, the downhole tool 118 may further include a biasing member 502 arranged between (interposing) the ball seat 210 and a support structure 504. The support structure 504 may be arranged within the body 202 uphole from the mill 120. The biasing member 502 may comprise, for example, a coil spring or the like, and may naturally bias the ball seat 210 to the first position. As the ball seat 210 is forced to the second position under hydraulic pressure, however, the biasing member 502 progressively compresses between the ball seat 210 and the support structure 504, thereby building spring force.

In FIG. 6, the perforating tool 122 has been activated, thereby perforating the tubing 116 and generating a perforation 602 in the tubing 116. More specifically, the perforating tool 122 may be actuated through hydraulic pressure supplied by the fluid 206 circulating into the annulus 132 or the hydraulic actuation chamber 216 through the exposed bypass ports 212. In some embodiments, actuating the perforating tool 122 will cause a piston or punch 604 to rapidly and forcefully extend laterally outward from a housing 606 and into striking contact with the inner wall of the tubing 116. The force of the punch 604 perforates the tubing and generates the perforation 602.

In some embodiments, the hydraulic pressure required to actuate the perforating tool 122 may be greater than the hydraulic pressure required to move the ball seat 210 from the first position to the second position. The punch 604 may laterally retract back into the housing 606 once the fluid pressure within the annulus 132 or the hydraulic actuation chamber 216 decreases. For example, the punch 604 may be spring-loaded and naturally retract back into the housing 606 once the hydraulic pressure decreases.

Figure 7:
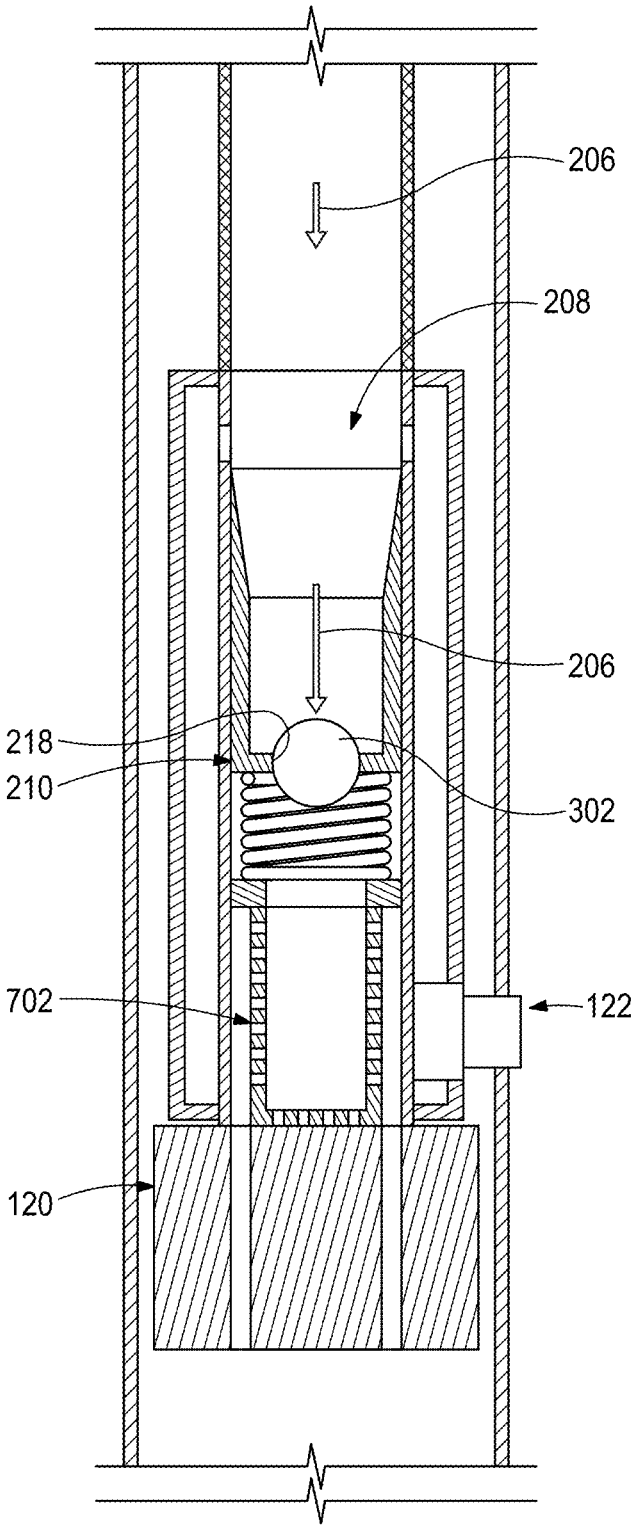

Referring now to FIG. 7, to resume operation of the mill 120 and cause the perforating tool 122 to revert back to is non-operative state, the fluid pressure within the fluid passage 208 may be increased further and to a point where the wellbore projectile 302 is forced through the central aperture 218 defined in the ball seat 210. More specifically, some or all of the ball seat 210, especially portions at or near the central aperture 218, may be made of a material configured to shear or fail upon assuming a predetermined load. Pumping the fluid 206 into the fluid passage 208 at an increased fluid pressure may force the wellbore projectile 302 against the ball seat 210 at the central aperture 218 until the predetermined load is achieved. Once the predetermined load is achieved, portions of the ball seat 210 will fail as the wellbore projectile 302 is forced through the central aperture 218. The wellbore projectile 302 may then be received at a ball catcher 702 located within the body 202 downstream from the ball seat 210 and the support structure 504.

Accordingly, in some embodiments, the hydraulic pressure required to move the ball seat 210 from the first position to the second position may comprise a first pressure P1, the hydraulic pressure required to actuate the perforating tool 122 may comprise a second pressure P2, and the hydraulic pressure required to force the wellbore projectile 302 through the ball seat 210 may comprise a third pressure, where $P1<P2<P3$.

Figure 8:
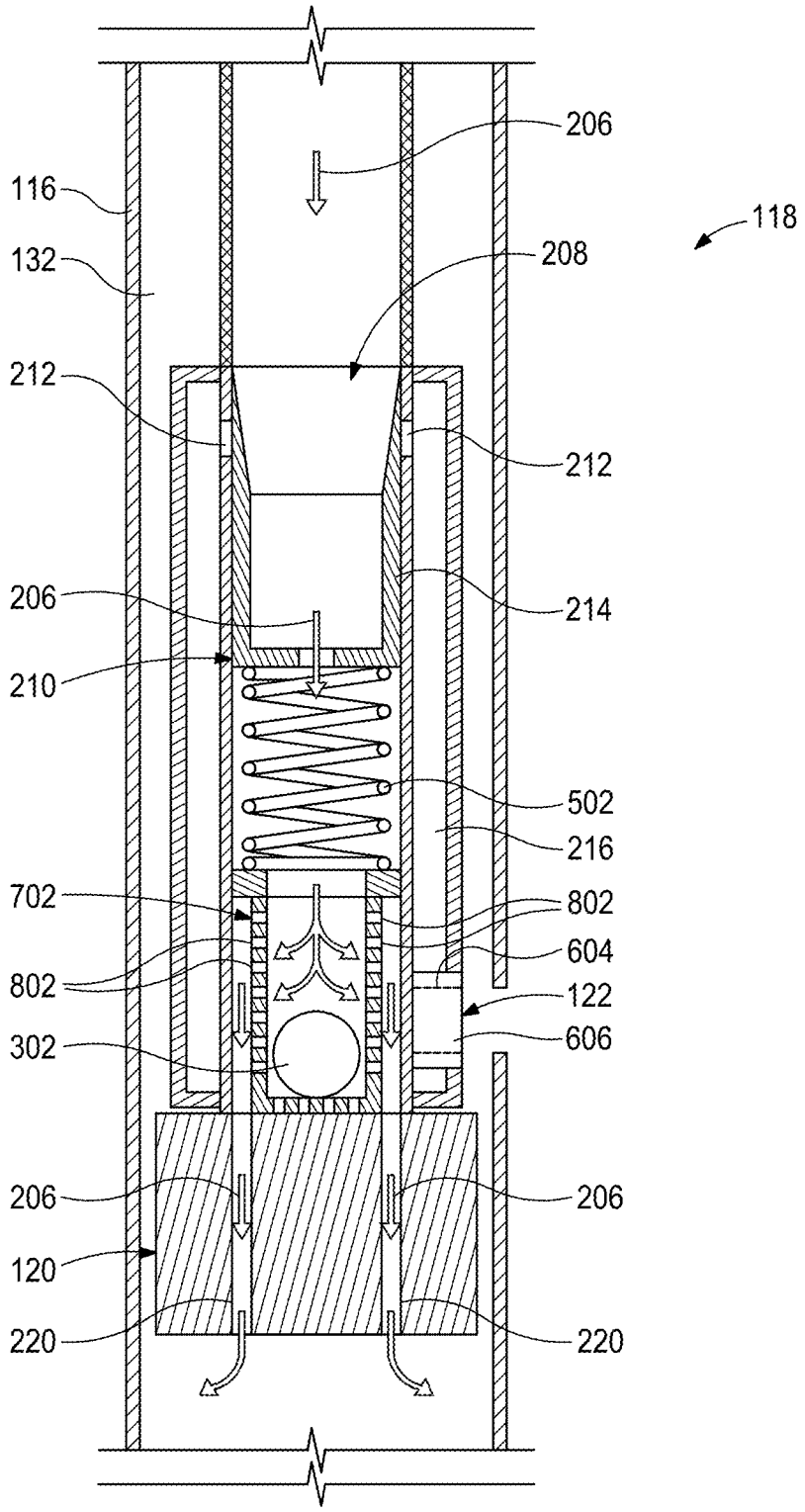

In FIG. 8, the wellbore projectile 302 has bypassed the ball seat 210 and is received within the ball catcher 702. Once the wellbore projectile 302 bypasses the ball seat 210, the spring force built up in the biasing member 502 may release, thereby moving the ball seat 210 from the second position back to the first position where the bypass ports 212 are once again occluded. In at least one embodiment, the sliding sleeve 214 may cover the bypass ports 212, as generally described above.

With the bypass ports 212 covered, the fluid pressure within the annulus 132 or the hydraulic actuation chamber 216 will correspondingly decrease, which will cause the perforating tool 122 to revert back to its non-operative state. More specifically, once the fluid pressure decreases, the punch 604 (shown in dashed lines) may laterally retract back into the housing 606. With the perforating tool 122 in the non-operative state, the downhole tool 118 may be able to once again move within the tubing 116 without the perforating tool 122 getting caught on obstructions.

With the bypass ports 212 covered, the fluid 206 may once again be conveyed into the downhole tool 118 and circulated to the mill 120. The fluid 206 may circulate past the ball seat 210 and into the ball catcher 702. In some embodiments, as illustrated, the ball catcher 702 may provide or otherwise define a plurality of apertures 802 through which the fluid 206 may flow to reach the mill 120. At the mill 120, as described above, the fluid 206 may be conveyed through the nozzles 220 defined in the mill 120 and subsequently discharged into the surrounding annulus 132.

It is to be appreciated that the foregoing operational steps in operating the downhole tool 118 may be repeated with a larger wellbore projectile until the ball seat 210 can no longer offer an adequate support surface.

Figure 9:
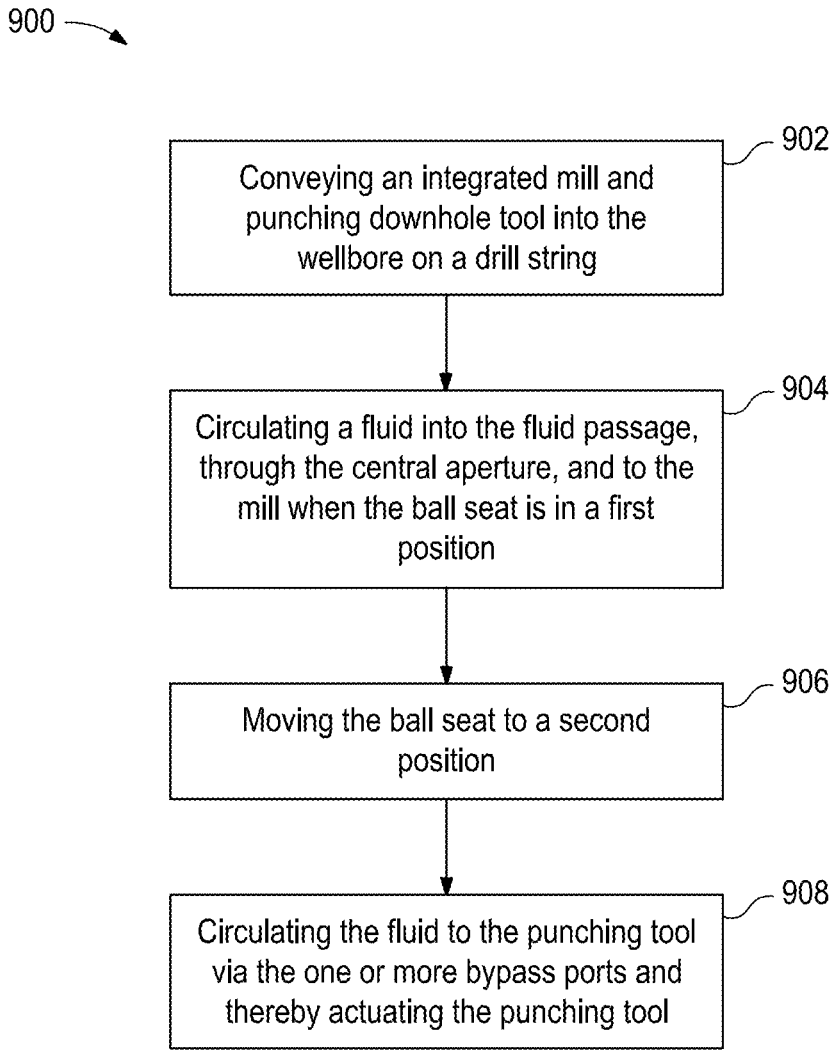
FIG. 9 is a schematic flowchart of an example method of using the downhole tool described herein, according to the principles of the present disclosure.

FIG. 9 is a schematic flowchart of an example method 900 of using the downhole tool 118 described herein, according to the principles of the present disclosure. As illustrated, the method 900 may include conveying an integrated mill and perforating downhole tool into the wellbore on a drill string, as at 902. As described herein, the integrated mill and perforating downhole tool may include an elongate body having opposing first and second ends and defining a fluid passage extending therebetween, a mill operatively coupled to the body at the second end, a perforating tool operatively coupled to the body at a location between the first and second ends, and a ball seat arranged within the fluid passage and defining a central aperture. The method 900 may further include circulating a fluid into the fluid passage, through the central aperture, and to the mill when the ball seat is in a first position, as at 904. When the ball seat is in the first position, one or more bypass ports defined in the body are blocked.

The method 900 may further include moving the ball seat to a second position, as at 906. When the ball seat is in the second position the bypass ports are exposed. The method 900 may then include circulating the fluid to the perforating tool via the one or more bypass ports and thereby actuating the perforating tool, as at 908.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. An integrated mill and perforating downhole tool, comprising:

an elongate body having opposing first and second ends and defining a fluid passage extending therebetween to receive a fluid;

an outer body disposed around the elongate body and defining a hydraulic actuation chamber between an inner surface of the outer body and an outer surface of the elongate body;

one or more bypass ports defined in the elongate body and in fluid communication with the hydraulic actuation chamber;

a mill operatively coupled to the elongate body at the second end;

a perforating tool operatively coupled to the outer body and in fluid communication with the hydraulic actuation chamber, the perforating tool including a punch housed within a housing and laterally moveable from a laterally retracted position to a laterally extended position, and from the laterally extended position to the laterally retracted position; and a ball seat arranged within the fluid passage and movable between a first position, where fluid communication is blocked between the hydraulic actuation chamber and the fluid passage via the one or more bypass ports, and a second position, where the one or more bypass ports are exposed and facilitate fluid communication between the fluid passage and the perforating tool through the hydraulic actuation chamber, wherein the mill is operable when the ball seat is in the first position, and wherein, when the ball seat is in the second position, fluid pressure within the fluid passage communicates with the perforating tool via the one or more bypass ports and the hydraulic actuation chamber to actuate the perforating tool.

2. The downhole tool of claim 1, wherein the fluid comprises at least one of a drilling fluid and a drilling mud.

3. The downhole tool of claim 1, further comprising a sliding sleeve coupled to the ball seat such that moving the ball seat correspondingly moves the sliding sleeve, wherein the sliding sleeve occludes the one or more bypass ports when the ball seat is in the first position, and wherein the sliding sleeve moves to expose the one or more bypass ports when the ball seat moves to the second position.

4. The downhole tool of claim 1, wherein the ball seat defines a central aperture and the fluid circulates through the central aperture when the ball seat is in the first position.

5. The downhole tool of claim 4, further comprising a wellbore projectile conveyable into the fluid passage and receivable at the ball seat to occlude the central aperture, wherein, increasing a fluid pressure within the flow passage to a first pressure after the wellbore projectile occludes the central aperture causes the ball seat to move to the second position.

6. The downhole tool of claim 5, further comprising a biasing member interposing the ball seat and a support structure arranged within the elongate body, wherein the biasing member is biased toward an expanded state to position the ball seat in the first position, the biasing member being progressively compressed toward a compressed state as the ball seat moves to the second position.

7. The downhole tool of claim 6, wherein at least a portion of the ball seat is made of a material configured to fail upon assuming a predetermined load, and wherein increasing the fluid pressure within the flow passage to a second pressure greater than the first pressure forces the wellbore projectile through the ball seat.

8. The downhole tool of claim 7, further comprising a ball catcher arranged within the elongate body downstream from the ball seat to receive the wellbore projectile after the wellbore projectile is forced through the ball seat.

9. The downhole tool of claim 1, further comprising a sliding sleeve having a first end and a second end, the second end is defined by the ball seat, the sliding sleeve being configured to block the one or more bypass ports when the ball seat is in the first position, wherein the one or more bypass ports interpose the first end and the ball seat when the ball seat is in the first position.

10. The downhole tool of claim 1, wherein the ball seat defines a central aperture and the fluid circulates through the central aperture when the ball seat is in the first position, the downhole tool further comprising a ball catcher arranged downstream from the ball seat to receive the wellbore projectile after the wellbore projectile is forced through the ball seat.

11. A method of milling and punching within a wellbore, comprising:

conveying an integrated mill and perforating downhole tool into a tubing disposed within the wellbore on a drill string, the integrated mill and perforating downhole tool including:

an elongate body having opposing first and second ends and defining a fluid passage extending therebetween;

a mill operatively coupled to the elongate body at the second end;

a perforating tool operatively coupled to the elongate body at a location between the first and second ends, the perforating tool including a punch housed within a housing and moveable between a laterally retracted position and a laterally extended position; and a ball seat arranged within the fluid passage and defining a central aperture;

circulating a fluid into the fluid passage, through the central aperture, and to the mill when the ball seat is in a first position, where one or more bypass ports defined in the elongate body are blocked;

moving the ball seat to a second position, where the one or more bypass ports are exposed;

circulating the fluid to the perforating tool via the one or more bypass ports and thereby actuating the perforating tool to laterally extend the punch from the laterally retracted position to the laterally extended position and forming a perforation in the tubing; and retracting the punch from the laterally extended position to the laterally retracted position after forming the perforation by decreasing a pressure within the fluid passage.

12. The method of claim 11, wherein moving the ball seat to the second position comprises:

conveying a wellbore projectile through the drill string and into the fluid passage;

receiving the wellbore projectile at the ball seat and thereby occluding the central aperture;

increasing a fluid pressure within the flow passage to a first pressure and thereby moving the ball seat to the second position.

13. The method of claim 12, further comprising:

increasing the fluid pressure within the flow passage to a second pressure greater than the first pressure;

forcing the wellbore projectile through the ball seat;

moving the ball seat back to the first position; and circulating the fluid into the fluid passage and to the mill.

14. The method of claim 12, wherein circulating the fluid to the perforating tool via the one or more bypass ports and thereby actuating the perforating tool comprises circulating the fluid through the one or more bypass ports while the central aperture is occluded by the wellbore projectile.

15. The method of claim 12, wherein circulating the fluid to the perforating tool and thereby actuating the perforating tool comprises:

circulating the fluid to the perforating tool via a hydraulic actuation chamber extending between the one or more bypass ports and the perforating tool, the hydraulic actuation chamber being defined between an outer surface of the elongate body and an inner surface of an outer body arranged around the elongate body; and increasing the fluid pressure with the flow passage to a second pressure greater than the first pressure and thereby actuating the perforating tool.

16. The method of claim 15, wherein retracting the punch further comprises decreasing the fluid pressure less than the first and second pressures within the flow passage and thereby causing the perforating tool to revert back to a non-operative state where the punch laterally retracts back into the housing to the laterally retracted position.

17. The method of claim 11, wherein the integrated mill and perforating downhole tool further includes a biasing member interposing the ball seat and a support structure arranged within the elongate body to bias the ball seat toward the first position, and wherein moving the ball seat to the second position comprises progressively compressing the biasing member from an expanded state to a compressed state as the ball seat moves to the second position.

18. The method of claim 11, wherein the one or more bypass ports are located uphole of the ball seat and the central aperture when the ball seat is in the first and second positions.

19. An integrated mill and perforating downhole tool, comprising:

an elongate body having opposing first and second ends and defining a fluid passage extending therebetween to receive a fluid;

a mill operatively coupled to the elongate body at the second end;

a perforating tool operatively coupled to the elongate body at a location between the first and second ends;

a ball seat arranged within the fluid passage and movable between a first position, where one or more bypass ports defined in the elongate body are blocked, and a second position, where the one or more bypass ports are exposed and facilitate fluid communication between the fluid passage and the perforating tool, wherein the ball seat defines a central aperture and the fluid circulates through the central aperture when the ball seat is in the first position;

a biasing member interposing the ball seat and a support structure arranged within the elongate body, wherein the biasing member is progressively compressed as the ball seat moves to the second position;

a wellbore projectile conveyable into the fluid passage and receivable at the ball seat to occlude the central aperture; and a ball catcher arranged downstream from the ball seat to receive the wellbore projectile when the wellbore projectile is forced through the ball seat, wherein increasing a fluid pressure within the flow passage to a first pressure after the wellbore projectile occludes the central aperture causes the ball seat to move to the second position, and at least a portion of the ball seat is made of a material configured to fail upon assuming a predetermined load, wherein increasing the fluid pressure within the flow passage to a second pressure greater than the first pressure forces the wellbore projectile through the ball seat, and wherein the mill is operable when the ball seat is in the first position, and wherein, when the ball seat is in the second position, fluid pressure within the fluid passage communicates with the perforating tool via the one or more bypass ports to actuate the perforating tool.

20. The downhole tool of claim 19, further comprising a sliding sleeve having a first end and a second end, the second end is defined by the ball seat, the sliding sleeve being configured to block the one or more bypass ports when the ball seat is in the first position, wherein the one or more bypass ports interpose the first end and the ball seat when the ball seat is in the first position.

* * * * *